United States Patent [19]

Miller et al.

[11] Patent Number: 5,054,259

[45] Date of Patent: Oct. 8, 1991

[54] APPARATUS FOR POSITIONING A SPACER PANEL

[75] Inventors: James E. Miller, Jeffersontown, Ky.; Byron L. Lowe; Everett N. Finn, both of Macon, Ga.; Kenneth M. Milliner, Macon, Ga.

[73] Assignee: Brown & Williamson Tobacco Corporation, Louisville, Ky.

[21] Appl. No.: 588,893

[22] Filed: Sep. 27, 1990

[51] Int. Cl.[5] ..... B65B 19/04; B65B 41/08; B65B 41/18; B65B 59/00

[52] U.S. Cl. ..... 53/157; 53/135.1; 271/246

[58] Field of Search ..... 53/415, 445, 447, 474, 53/156, 157, 540, 238, 244, 263, 393, 137; 271/246, 247

[56] References Cited

U.S. PATENT DOCUMENTS

| | | | |
|---|---|---|---|
| 1,200,227 | 10/1916 | Pantazi | 53/157 X |
| 3,762,126 | 10/1973 | Court | 53/157 X |
| 4,458,468 | 7/1984 | Sivilich | 53/445 X |
| 4,912,910 | 4/1990 | Lowe et al. | 53/157 X |
| 4,938,656 | 7/1990 | Gamberini et al. | 53/157 X |

*Primary Examiner*—Horace M. Culver
*Attorney, Agent, or Firm*—Charles G. Lamb

[57] ABSTRACT

An apparatus for properly positioning a spacer panel relative to a container of items and a package blank which will be subsequently folded around the item container and spacer panel to form a package enclosing the item container and spacer panel. The positioning apparatus includes a plate for receiving and supporting the package blank, spacer panel, and item container in a stacked relationship with the spacer panel disposed between the package blank and item container, and a spacer panel contact blade which is movable back and forth over the plate top to contact just the panel spacer and moving the panel spacer between the package blank and item container to a predetermined location still between the package blank and item container such that when the package blank is subsequently folded to form the package, the panel spacer will be properly positioned therein.

7 Claims, 3 Drawing Sheets

APPARATUS FOR POSITIONING A SPACER PANEL

BACKGROUND Of THE INVENTION

1. Field of the Invention

The present invention relates to package making and more particularly to an apparatus for forming groups of contents of a package unit prior to a further package forming operation.

2. Description of the Prior Art

The present invention has particular utility in the field of packaging cigarettes.

Cigarettes have, historically, been manufactured having a certain circumference and packaged in groups of twenty cigarettes. Recently, cigarettes have been developed having satisfactory smoking characteristics which have a substantially smaller circumference than the heretofore known cigarettes. These new "thinner" cigarettes are also packaged in groups of twenty to a package because twenty cigarette packages are popular with the purchasing public.

Further, by way of background, cigarette packages are typically made to a standard size,. particularly in thickness, basically for two reasons. First, the end of the cigarette package must be large enough so that a tax stamp can be placed on the package end, and second, cigarette package dispensing machines are made to dispose cigarette packages of one standard size.

The new "thinner" cigarette, when packaged in groups of twenty in a conventionally sized package, leave space within the package. In order to prevent the "thinner" cigarettes from moving within the package, flat spacers are included in the package to occupy the left-over space therein.

It is a problem in a high volume packaging operation to insert these package spacers in a proper location within the package without slowing up the packaging operation.

SUMMARY OF THE INVENTION

The present invention provides an apparatus for properly positioning a panel spacer in a high volume manufacturing process without slowing the packaging process.

More particularly, the present invention provides an apparatus for positioning a spacer panel relative to a container of items and a package blank which is to be subsequently folded around the item container and spacer panel to form a package enclosing the item Container and spacer panel, the spacer positioning apparatus comprising a plate for receiving thereon the package blank, spacer panel, and item container which are in a stacked relationship with the package blank on the bottom resting on the top surface of the plate, the spacer panel on top of the package blank, and the item container on top of the spacer panel; a movable spacer panel blade movable back and forth over the plate from one side of the plate toward the opposite side of the plate, the blade being positioned relative to the top surface of the plate to make contact with one side edge of only the panel spacer of the package blank, spacer panel, and, item container stack resting on the plate; guide means located toward the opposite side of the plate from the movable blade in contacting relation position with one side edge of the panel spacer and one side of the item container and not contactable with the package blank; and, means for moving the spacer panel blade back and forth over the plate into and out of control with the panel spacer such that when the spacer panel blade moves forth over the plate, it contacts one edge of the panel spacer and moves the panel spacer relative to the package blank and item container against the guide means to correctly position the spacer panel relative to the package blank and item container.

BRIEF DESCRIPTION OF THE DRAWINGS

A better understanding of the invention will be had upon reference to the following description in conjunction with the accompanying drawings in which like numerals refer to like parts throughout the views and wherein.

DETAILED DESCRIPTION OF THE PREFERRED EMBODIMENT

Figure 1:
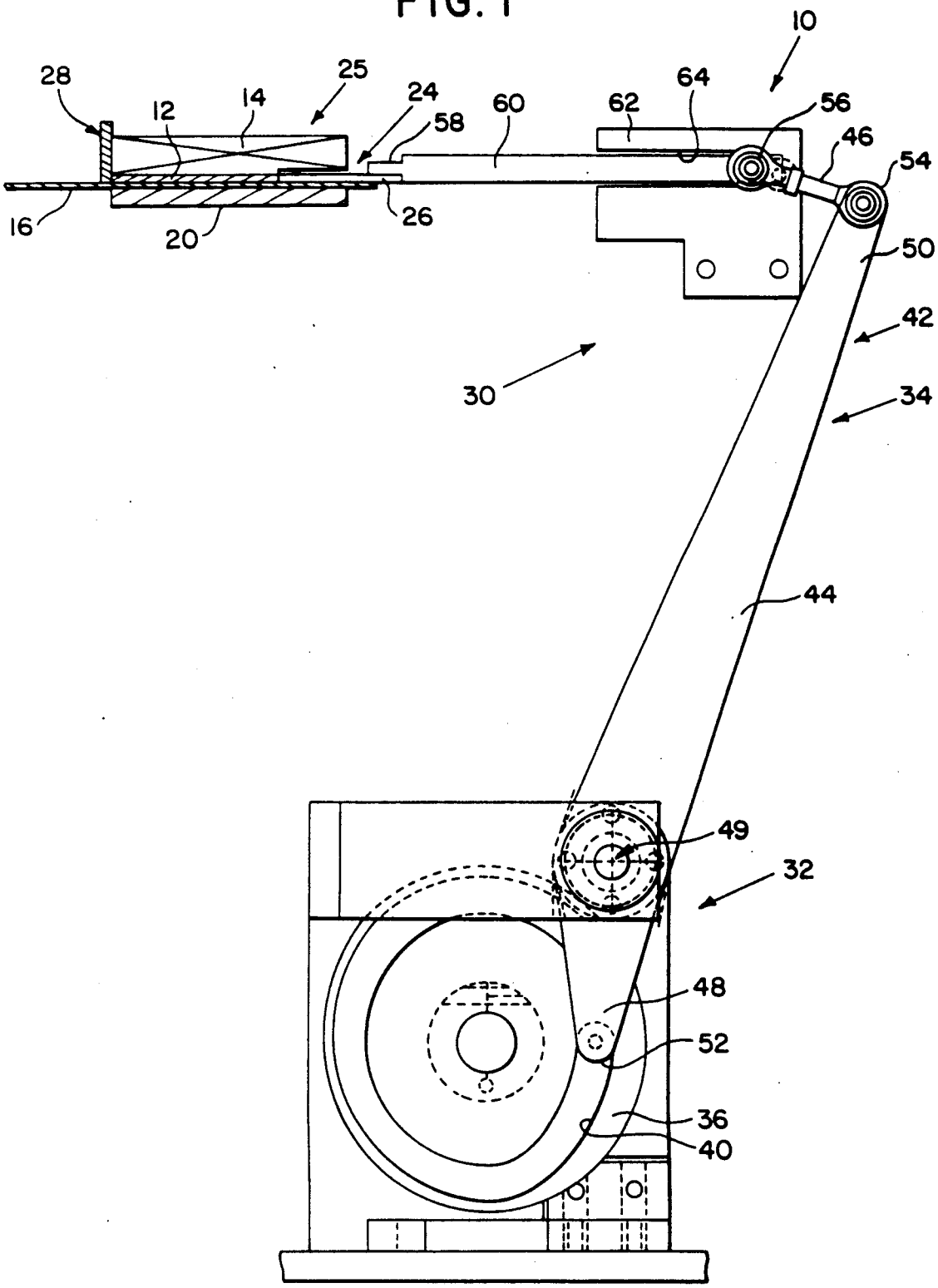
FIG. 1 is a schematic side view of the apparatus for the invention.
Figure 2:
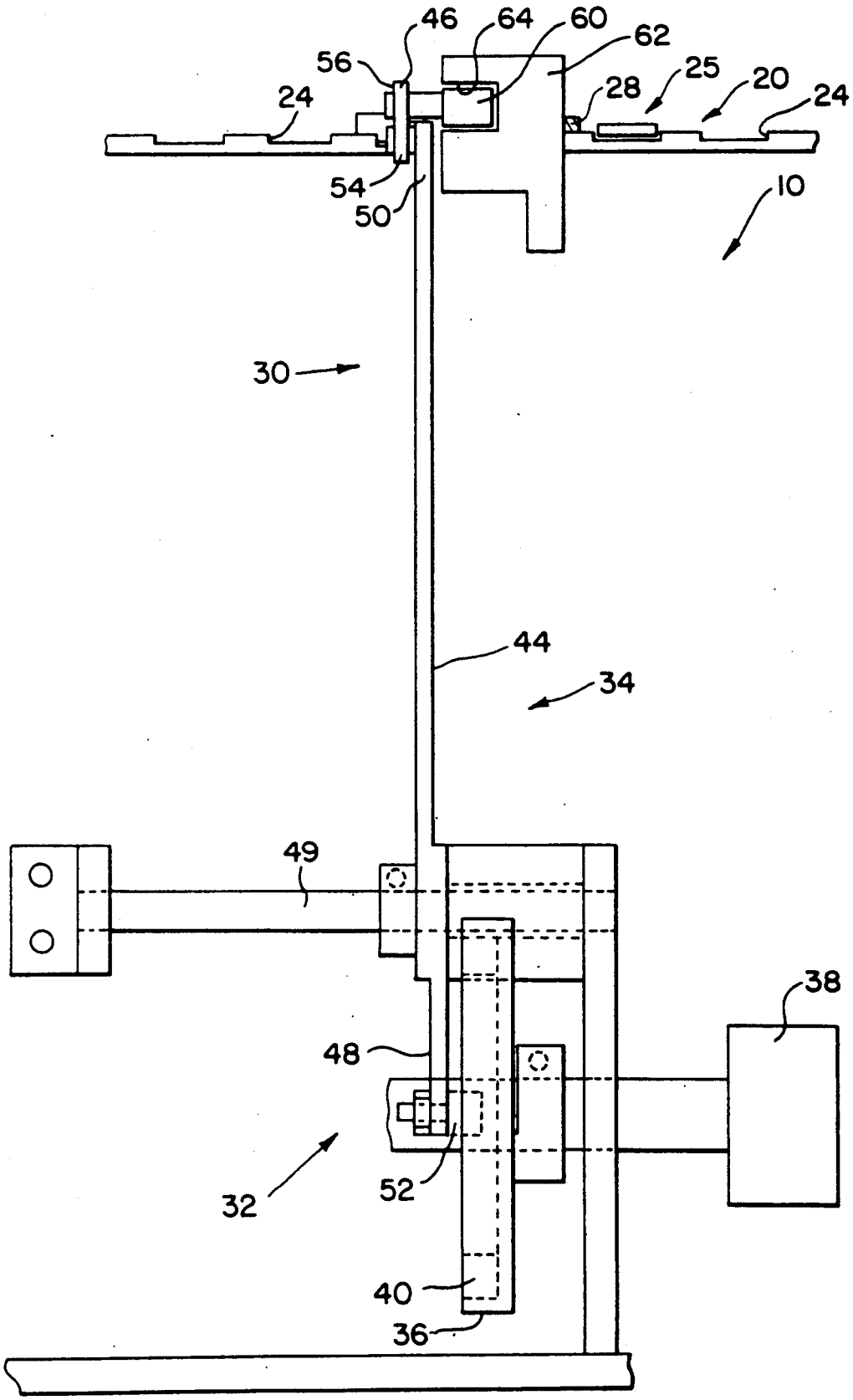
FIG. 2 is a top view as seen in the direction of arrows 2—2 in FIG. 1; and, FIG. 3 is a cross-sectional view of a package with portions broken away to show internal details thereof.

With reference to FIGS. 1 and 2, there is shown an apparatus, generally denoted as the numeral 10, for positioning a spacer panel 12 relative to a container of items 14 and a package blank 16 which is to be subsequently folded around the item container 14 and spacer panel 12 to form a package 18 (see FIG. 3) enclosing the item container 14 and the spacer panel 12.

The operation of folding the package blank 16 to form the package 18 is performed at a workstation (not shown) downstream of the spacer positioning apparatus 10.

Figure 3:
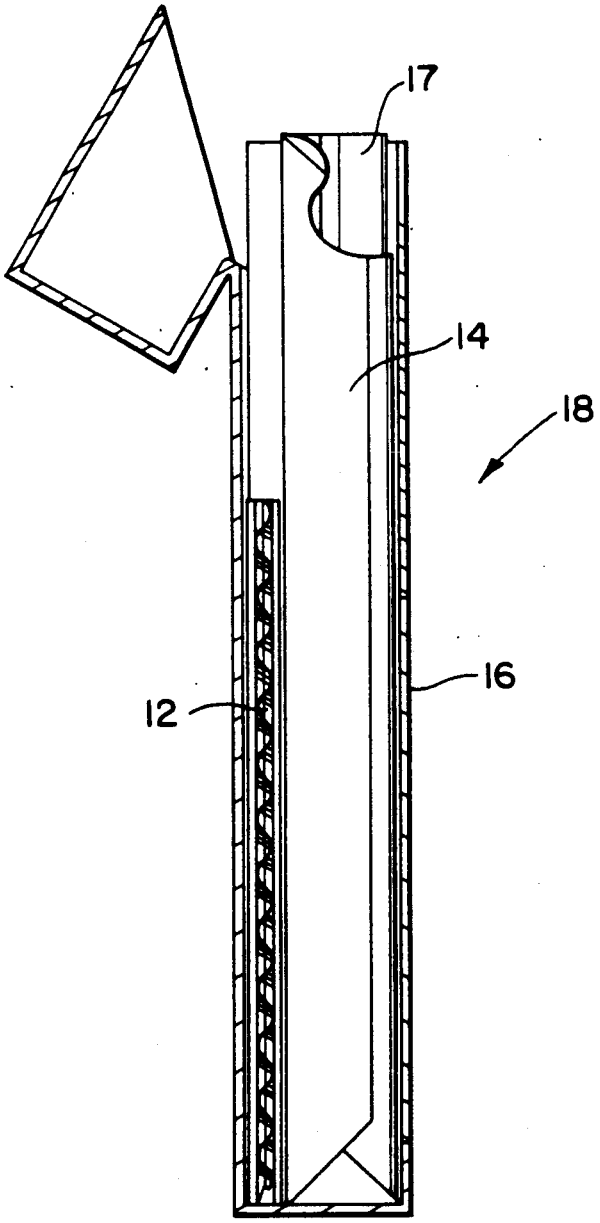

With reference to FIG. 3, the spacer positioning apparatus 10 is useful in performing an interim step in the manufacture of the package 18 which is illustrated as a cigarette package. The cigarette package 18 is shown as being of the type,commonly referred to as a "Flip-Top" box wherein the package blank 16 which is folded to form the package is fabricated of a cardboard material. The item container 14 is typically fabricated of a metal foil material enclosing the cigarettes 17 to keep the cigarettes fresh. The spacer panel 12 is fabricated of a relatively stiff material such as cardboard and is located in the package 18 adjacent one of the walls of the package, for example, the back wall, with the top edge of the spacer panel 12 disposed beneath the top edge of the adjacent package wall.

Now with reference to FIGS. 1 and 2, the apparatus 10 comprises a conveyor device 20 including a moving top flight 22 having a plurality of open ended pockets 24 spaced apart longitudinally of the conveyor top flight 22. The pockets 24 extend transversely across the top flight 22 so that the open ends of the pockets 24 are open at both lateral sides of the conveyor top flight 22. The pockets 24 each contain a stack 25 of package components including the package blank 16, spacer panel 12, and item container 14 in stacked relationship with the package blank 16 on the bottom, the spacer panel 12 being on top of the package blank 16, and the item container 14 being on top of the spacer panel 12. The function of the conveyor pockets 24 is to maintain a proper interval between successive package component stacks 25 being fed to the apparatus 10 and subsequent downstream package folding or forming operations. The width of the conveyor device 20, and therefore, the length of the pockets 24, is generally equal to the height of an item container 14. The package blank 16, being longer than the height of the item container 14, and therefore, the width of the conveyor to flight 22, projects through the open ends of the pockets 24 past the lateral sides of the conveyor 20.

A movable spacer panel pushing blade 26 is located adjacent one lateral side of the conveyor 20 and is mounted for movement back and forth transversely over the conveyor 20 into and out of a pocket 24 when a pocket is positioned at the location of the blade 26. The pushing blade 26 is located in alignment with the spacer panel 12 located with the pocket 24 so that the distal end of the blade 26 will contact one edge of the spacer panel 12 in the pocket 24 as the pusher blade 26 moves through one open end of the pocket 24 into the pocket 24.

A fixed guide and stop plate 28 is located adjacent the conveyor 20 to the opposite lateral side of the conveyor 20 from the spacer panel pushing blade 26. The guide and stop plate 28 extends parallel to the adjacent lateral side of the conveyor 20 across the conveyor 20 from the spacer panel pusher blade 26 and extends along the open end of the pocket 24 opposite that open pocket end through which the spacer panel pusher blade 26 moves into and out of the pocket 24. The bottom edge of the stop plate 28 is located at an elevation of the package blank 16 in the pocket 24 so that the portion of the package blank 16 projecting through the open end of the pocket 24 will pass beneath the guide and stop plate 28.

The apparatus 10 further includes means 30 for moving the spacer panel blade pusher blade 26 back and forth transversely of the conveyor 20 into and out of the pocket 24 to contact one edge of the spacer panel 12. The blade moving means 30 includes cam means 32 and interconnecting means 34 operatively interconnecting the cam means 32 to the blade 26 to move the blade 26 in a reciprocating motion. As shown best in FIG. 1, the cam means 32 includes a rotatable cam 36 mounted to an appropriate framework beneath the elevation of the conveyor 20 and pusher blade 26. The rotatable cam 36 includes a motor 38 for rotating the rotatable cam 36 at a constant speed. The motor 38 can also be used to drive the conveyor device 20. A perimeter groove 40 is formed in one face of the rotatable cam 36 to define the cam development. The interconnecting means 34 comprises a two bar mechanism 42 which includes a first bar 44 and a second bar 46 for translating the rotary motion of the rotatable cam 36 to a linear motion to drive the spacer pusher blade 26. The first bar 44 is mounted to the apparatus framework between its proximal end 48 and its distal end 50 for pivotable movement on an axle 49. A cam follower 52 is located at the proximal end 48 of the first bar 44 and is received in the perimeter cam groove 40 of the rotatable cam 36. The second bar 46 is pivotable connected at its proximal end 54 to the distal end 48 of the first bar 44.

With continued reference to FIG. 1, the spacer panel pusher blade 26 is mounted to the distal end 58 of a blade attachment rod 60 for movement therewith. The blade attachment rod 60 is mounted in a slide block 62 for movement in a linear direction. The slide block 62 is horizontally disposed and located between the conveyor 20 and the distal end 56 of the second bar 46, and is supported on the apparatus framework. The slide block 62 has a channel 64 which receives the blade attachment rod 60 for slidable movement within the channel 62. The proximal end of the blade attachment rod 60 is pivotably attached to the distal end 56 of the second bar 46. The cam means 32 provides for reciprocating the blade 26 in timed relationship to the movement of the conveyor device 20 so that the blade 26 will move toward a pocket 24 of the conveyor 20 only when a pocket 24 is in alignment with the blade 26.

In operation of the apparatus 10, the components of the package 18 consisting of the package blank 16, spacer panel 12 and item container 14 are stacked in the conveyor pockets 24 at a location upstream of the position of the pusher blade 26. The conveyor device 20 moves the component stacks 25 in the conveyor pockets 24 to the location of the pusher blade 26. The blade 26 then moves toward the adjacent open end of the pocket 24 and contacts the edge of the spacer panel 12 and pushes the spacer panel 12 toward the opposite end of the pocket 24 so that the spacer panel 12 will he at the bottom of the package 18 when the package blank 16 is folded over the spacer panel 12 and item container 14 to form the package 18.

The foregoing detailed description is given primarily for clearness of understanding and no unnecessary limitations should be understood therefrom for modifications will become obvious to those skilled in the art upon reading this disclosure and may be made without departing from the spirit of the invention and scope of the appended claims.

What is claimed is:

1. An apparatus for positioning a spacer panel relative to a container of items and a package blank which is to be subsequently folded around the container and spacer panel to form a package enclosing the item container and spacer panel, the spacer positioning apparatus comprising:

conveyor means for moving a plurality of package components consisting of a package blank, spacer panel, and item container which are in a stacked relationship with the package blank resting On the conveyor means, the spacer panel on top of the package blank, and the item container on top of the spacer panel;

a movable spacer panel blade movable back and forth transversely over the conveyor means, the blade being positioned relative to the conveyor means to make contact with one side edge of only the spacer panel of the package component stack for moving the spacer panel relative to the package blank and item container to a predetermined position relative to the package blank and item container; and, means for moving the spacer panel blade in reciprocating motion toward and away from the conveyor means.

2. The apparatus of claim 1, further comprising spacer panel stop means positioned across the conveyor means from the movable spacer panel blade for contacting the side edge of the spacer panel opposite the side edge of the spacer panel contacted by the blade when the panel is moved by the blade to the predetermined position.

3. The apparatus of claim 2, wherein the spacer panel stop means is also in contactable position with the item container and out of contactable position with the package blank.

4. The apparatus of claim 1, further comprising means for moving the spacer panel blade in timed relationship with the movement of the conveyor means.

5. The apparatus of claim 1, wherein the spacer panel blade moving means comprises cam means;

means for moving the cam means; and, means operatively interconnecting the cam means to the spacer panel blade.

6. The apparatus of claim 5, wherein the cam means comprises:

a rotatable cam;

the cam moving means rotates the cam means at a constant velocity; and, cam follower means interconnecting the rotatable cam and the interconnecting means.

7. The apparatus of claim 6, wherein the interconnecting means comprises:

a first bar mounted between its proximal and distal ends for pivotable movement;

the cam follower means is attached to the distal end of the first bar;

a second bar pivotably connected at its proximal end to the proximal end of the first bar; and, the distal end of the second bar being interconnected to the spacer panel blade.

* * * * *